US005215144A

United States Patent [19]

May et al.

[11] Patent Number: 5,215,144

[45] Date of Patent: Jun. 1, 1993

[54] HEAT EXCHANGER

[75] Inventors: Karl May, Bad-Vilbel; Hartmut Herm, Dreieich, both of Fed. Rep. of Germany

[73] Assignee: Siemens Aktiengesellschaft, Munich, Fed. Rep. of Germany

[21] Appl. No.: 837,321

[22] Filed: Feb. 18, 1992

[30] Foreign Application Priority Data

Feb. 18, 1991 [DE] Fed. Rep. of Germany ..... 4104959

[51] Int. Cl.[5] ..... F28D 7/12; F28F 3/12

[52] U.S. Cl. ..... 165/154; 165/169

[58] Field of Search ..... 165/169, 142, 154

[56] References Cited

U.S. PATENT DOCUMENTS

| | | | |
|---|---|---|---|
| 2,445,471 | 7/1948 | Buckholdt | 165/154 |
| 2,641,451 | 6/1953 | Kaiser | 165/142 |
| 2,823,026 | 2/1958 | D'Amico et al. | 165/154 |
| 2,900,168 | 8/1959 | Nyborg | 165/154 |
| 3,143,404 | 8/1964 | Heigl | 165/169 |
| 3,475,922 | 11/1969 | Scott et al. | 165/154 |
| 3,859,040 | 1/1975 | Shefsiek et al. | 165/154 |
| 4,096,616 | 6/1978 | Coffinberry | 165/154 |
| 4,113,009 | 9/1978 | Meyer et al. | 165/154 |
| 4,121,611 | 10/1978 | Bayerl | 165/154 |
| 4,878,440 | 11/1989 | Tratz er al. | 110/229 |

FOREIGN PATENT DOCUMENTS

| | | |
|---|---|---|
| 0083379 | 7/1983 | European Pat. Off. . |
| 0302310 | 2/1989 | European Pat. Off. . |
| 814159 | 7/1951 | Fed. Rep. of Germany . |
| 839806 | 4/1952 | Fed. Rep. of Germany . |
| 1401851 | 10/1968 | Fed. Rep. of Germany . |
| 1210108 | 3/1960 | France . |
| 920337 | 3/1963 | United Kingdom . |
| 2065861 | 7/1981 | United Kingdom . |

*Primary Examiner*—John Rivell
*Assistant Examiner*—L. R. Leo
*Attorney, Agent, or Firm*—Herbert L. Lerner; Laurence A. Greenberg

[57] ABSTRACT

A heat exchanger includes a primary chamber for a primary medium and a secondary chamber for a secondary medium. A gas-tight heat-conducting wall separates the chambers from one another. An outer jacket sheet is disposed at a distance from the wall and defines the secondary chamber along with the wall. A profiled sheet is disposed between the wall and the outer jacket sheet and subdivides the secondary chamber into an inner partial chamber and an outer partial chamber.

18 Claims, 3 Drawing Sheets

HEAT EXCHANGER

The invention relates to a heat exchanger having a primary chamber for a primary medium, a secondary chamber for a secondary medium, and a gas-tight, heat-conducting wall dividing the chambers from one another.

A heat exchanger serves to transfer heat energy from a hot primary medium to a cold secondary medium. However, the two mediums should not be mixed with one another. Various embodiments of such a heat exchanger are known. One of them provides a container in which a plurality of parallel-connected tubes are disposed. Ribs are provided as spacers between adjacent tubes. The parallel tubes are part of a secondary loop, which is ducted in gas-tight fashion through a container wall. The interior of the tubes forms the secondary chamber through which the heat-absorbing secondary medium flows. The remaining internal space of the container is part of a primary loop and it forms the primary chamber through which a hot primary medium is conducted.

Such a heat exchanger can also be used in an incineration or thermal waste disposal plant as described in Published European Application No. 0 302 310 A1, corresponding to U.S. Pat. No. 4,878,440. Heat energy from hot flue gas is delivered through a secondary medium to the contents of a pyrolysis drum. With a known heat exchanger used in that way, the tubes carrying the secondary medium must be formed of a material that is resistant to high temperatures. It may be necessary for the tubes to be coated with a fireproof composition. To that end, the tubes have to be provided with metal pins, between which a fireproof ceramic composition is then held in place.

Heat exchangers in which the secondary chamber is formed by parallel tubes are manufactured at great effort and with high cost. Even the tubes that are needed are quite expensive. Joining the tubes with ribs necessitates complicated and expensive welding work.

If that type of heat exchanger, having such parallel tubes, is used in an incineration or thermal waste disposal plant in which the primary medium is a hot flue gas, the tube surfaces must be coated with a fireproof composition. Due to the curved surfaces of the tubes, that is complicated to accomplish. Even welding the necessary pins together cannot be performed by machine, because of the curved surface, and requires expensive manual labor.

It is accordingly an object of the invention to provide a heat exchanger, which overcomes the hereinaforementioned disadvantages of the heretofore-known devices of this general type, which can be assembled quickly, using simple, economical means, and which nevertheless functions reliably. In particular, material strain, or even destruction, for example of welds, should not be caused by unequal thermal expansions of different components of the heat exchanger, which may occur.

With the foregoing and other objects in view there is provided, in accordance with the invention, a heat exchanger, comprising a primary chamber for a primary medium, a secondary chamber for a secondary medium, a gas-tight heat-conducting wall separating or dividing the chambers from one another, an outer jacket sheet being disposed at a distance from the wall and defining the secondary chamber along with the wall, and a profiled sheet being disposed between the wall and the outer jacket sheet and subdividing the secondary chamber into an inner partial chamber and an outer partial chamber.

The disposition of the profiled sheet forms tube-like conduits that serve as a secondary chamber. In order to provide for its production, the heat exchanger according to the invention therefore requires only economical profiled sheet metal, instead of expensive tubes, and even more-inexpensive unprofiled sheet metal for the outer jacket sheet. With this inexpensively obtained material, according to the invention, parallel-extending conduits for the secondary medium are constructed that have an effect which is equivalent to the expensive, rib-connected parallel tubes. This is true even though the conduits often are not partitioned off from one another.

By placing the profiled sheet in the space between the wall and the outer jacket sheet, two partial chambers are formed, each of which is compartmented by the profiled sheet into parallel-extending conduits. The conduits of the inner partial chamber are defined directly by the wall that separates the secondary chamber from the primary chamber. The secondary medium flowing in the inner partial chamber is therefore heated first. This heated secondary medium can then give up heat energy to the secondary medium in the outer partial chamber through the profiled sheet.

In accordance with another feature of the invention, the profiled sheet extends in the flow direction of the primary medium and is profiled in a plane at right angles to the flow direction of the primary medium.

Since the secondary medium can flow through the inner conduits in the same direction or in a countercurrent to the primary medium, a good heat transfer through the heat-conducting wall between the primary chamber and the secondary chamber is assured.

In accordance with a further feature of the invention, the profiled sheet alternatingly touches the wall that defines the primary chamber and the outer jacket sheet, forming compartmented partial chambers in the inner and outer partial chambers and maintaining the outer jacket sheet at a constant distance from the wall.

The profiled sheet may be clamped in place. It is an advantage that welded connections are unnecessary.

An advantage which is attained is that the wall, the profiled sheet and the outer jacket sheet assume a fixed position relative to one another in the radial direction, or at right angles to the direction of flow, while they are displaceable freely relative to one another in response to thermal expansion in the direction of the axis of the heat exchanger or in the flow direction.

In accordance with an added feature of the invention, the profiled sheet has a secured upper portion which is the only portion at which it is secured, and it hangs freely downward between the wall and the outer jacket sheet.

This has the advantage of preventing unequal thermal expansion of the jacket sheet, the wall and the profiled sheet from having any effect on the remaining construction. Unequal thermal expansions of rigidly joined components could cause warping or even cracks.

In accordance with an additional feature of the invention, there is provided an inflow line and an outflow line, the profiled sheet having two ends, the inner and outer partial chambers being joined together and closed off from the outside at one of the ends of the profiled sheet, and the outer partial chamber communicating with the inflow line and the inner partial chamber communicating with the outflow line at the other of the ends of the profiled sheet.

The one end, at which the two partial chambers of the secondary chamber communicate with one another, may be at the bottom end of the heat exchanger. The other end, at which the outer partial chamber communicates with the inflow line, and the inner partial chamber communicates with the outflow line, may be at the top end of the heat exchanger.

This makes it possible to conduct the secondary medium twice through the secondary chamber. The secondary medium first flows within the outer partial chamber, for instance in its conduits, and is then deflected and then flows back in the opposite direction in the inner partial chamber, for instance in its conduits. The outer partial chamber communicates with the inflow line in order to provide for the delivery of the secondary medium. The inner partial chamber communicates with the outflow line in order to provide for the removal of the secondary medium.

The advantage which is attained with this configuration is that the same secondary medium is conducted twice through the secondary chamber. Conducting the secondary medium in the opposite direction has the advantage of permitting the warmer medium flowing in the inner partial chamber to preheat the cooler medium flowing in the outer partial chamber, through the profiled sheet.

In accordance with yet another feature of the invention, there is provided a bottom, the wall and the outer jacket sheet being joined in gas-tight fashion at the one end of the profiled sheet, and the one end of the profiled sheet ending at a distance from the bottom.

Therefore, at one end surface of the heat exchanger, the outer jacket sheet is joined to the wall of the primary chamber in a gas-tight manner by means of the bottom, and the profiled sheet ends at a distance from the bottom. With this construction, the partial chambers of the secondary chamber communicate with one another, and a gas flow can advantageously be guided around the end of the profiled sheet. The gas then flows from one partial chamber to the other, for example from the outer to the inner partial chamber. Nevertheless, it is assured that no gas can escape from the secondary chamber.

In accordance with yet a further feature of the invention, the bottom is elastic. The has the advantage of compensating for strains from unequal thermal expansions of the wall and the outer jacket sheet. Thermal expansions of the profiled sheet cannot cause strains, because it ends at a distance from the bottom and only needs to be secured at its upper portion.

In accordance with yet an added feature of the invention, there is provided a closure sheet having sides, the closure sheet extending between the profiled sheet and the outer jacket sheet and closing the outer partial chamber at the other end of the profiled sheet opposite the bottom, in other words at the top end of the heat exchanger; and first and second collecting conduits, the second collecting conduit being open toward the inner partial chamber and being disposed at one of the sides or at the end of the closure sheet, the second collecting conduit communicating with the outflow line; and the first collecting conduit being open toward the outer partial chamber and being disposed at the other of the sides or ends of the closure sheet, and the first collecting conduit communicating with the inflow line.

This construction assures that the secondary medium will flow solely into the outer partial chamber of the secondary chamber in the vicinity of one end surface of the heat exchanger. The first collecting conduit assures that the secondary medium will be distributed to compartmented partial chambers, formed by the profiled sheet. This first collecting conduit provides communication among all of the outer compartmented partial chambers. The secondary medium can accordingly flow from the inflow line through the first collecting conduit into every individual outer compartmented partial chamber. Since no further path through the closure sheet is possible, the secondary medium flows in the same direction between the profiled sheet and the outer jacket sheet. The flow direction of the secondary medium is reversed at the bottom that joins the wall of the primary chamber to the outer jacket sheet. It thus flows around the end of the profiled sheet and then flows between the profiled sheet and the wall of the primary chamber to the second collecting conduit. The inner compartmented partial chambers of the secondary chamber are made to communicate with one another through the use of the second collecting conduit. As a result, the secondary medium arriving from all of the inner compartmented partial chambers is collected and can then be removed through the outflow line.

The advantage of this construction is that after a brief startup time, the secondary medium in the outer partial chamber is preheated by the already heated medium in the inner partial chamber, because of a heat exchange through the profiled sheet.

In accordance with yet an additional feature of the invention, the first collecting conduit is mounted on the outer surface of the jacket sheet and the jacket sheet has a continuous opening to the first collecting conduit. With this embodiment it is assured that all of the outer compartmented partial chambers communicate with one another through the first collecting conduit even if the profiled sheet touches the jacket sheet.

In accordance with again another feature of the invention, the profiled sheet is secured in such a manner that it is suspended solely from its upper part. It may communicate with the wall of the primary chamber through the second collecting conduit. This provides a simple and effective construction, and because it is hung like a curtain, the profiled sheet can expand downward without causing strains or even cracks in the material.

In accordance with again a further feature of the invention, the profiled sheet has a polygonal profile. The profile may be rectangular or trapezoidal. In that case it can rest over a large surface area on the outer jacket sheet and/or on the wall of the primary chamber. The profile may also be triangular.

In accordance with again an added feature of the invention, the profiled sheet is a corrugated sheet, with a round and in particular sinusoidal profile. A corrugated sheet of this kind, in the necessary form, is available on the market. With the use of a known corrugated sheet, an advantage is attained which is that the cost for heat exchanger can be lowered even further. This is because corrugated sheet metal can be obtained at a low price, which is markedly below the price for tubes.

In accordance with again an additional feature of the invention, the profiled sheet and/or the jacket sheet and/or other parts of the secondary chamber are made of steel. An inexpensive steel is adequate, because in the heat exchanger of the invention, the profiled sheet and the jacket sheet do not come into contact with the hot primary medium. The hot primary medium strikes the wall of the primary chamber only.

While in a known embodiment with tubes and ribs, all of the parts come into contact with the hot primary medium and therefore must be manufactured from heat-resistant material, in accordance with still another feature of the invention, the profiled sheet and the jacket sheet are made of a simpler, more economical steel. This has the advantage of generally permitting any commercially available corrugated sheet metal to be used. Only the wall of the primary chamber needs to be of material that withstands high temperatures, such as 800° C.

In accordance with still a further feature of the invention, the wall between the primary chamber and the secondary chamber has pins on its side facing toward the primary chamber, and is tamped with a fireproof ceramic composition. This reliably prevents corrosion of the wall from hot primary medium that contains harmful substances.

The disposition of the pins on the wall can be performed by robot welding, because only a flat or slightly curved surface has to be pinned. This is an additional advantage of the heat exchanger of the invention as compared with the known heat exchanger, in which the surfaces of the tubes have to be pinned, which can only be done with expensive manual labor because of the pronounced curvature of the tube surfaces. The same is true for lining the pinned wall with the ceramic composition.

In accordance with still an added feature of the invention, the primary medium is a hot flue gas, and the secondary medium is a heating gas. With the heat exchanger according to the invention, it is thus possible for the heat energy of the hot flue gas to be used through the heating gas for heating or preheating some substance.

In accordance with a concomitant feature of the invention, the primary medium is a hot flue gas from a combustion chamber of an incineration or thermal waste disposal plant as described in Published European Application No. 0 302 310 A1, corresponding to U.S. Pat. No. 4,878,440, and the secondary medium is a heating gas for heating a pyrolysis reactor in an incineration or thermal waste disposal plant. Therefore, a heat exchanger according to the invention can logically be used in an incineration or thermal waste disposal plant that is known per se. Through the use of the heat exchanger, which can be constructed quickly, economically and reliably by simple means and which functions reliably, heat energy from the very hot flue gas can be conducted into the pyrolysis reactor to preheat the product to be incinerated there.

Accordingly, the heat exchanger of the invention can be constructed quickly with simple, commercially available and economical means, such as corrugated sheet metal, and it functions reliably. In particular, it cannot be impaired in its function by thermal expansion of its material.

Other features which are considered as characteristic for the invention are set forth in the appended claims.

Although the invention is illustrated and described herein as embodied in a heat exchanger, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
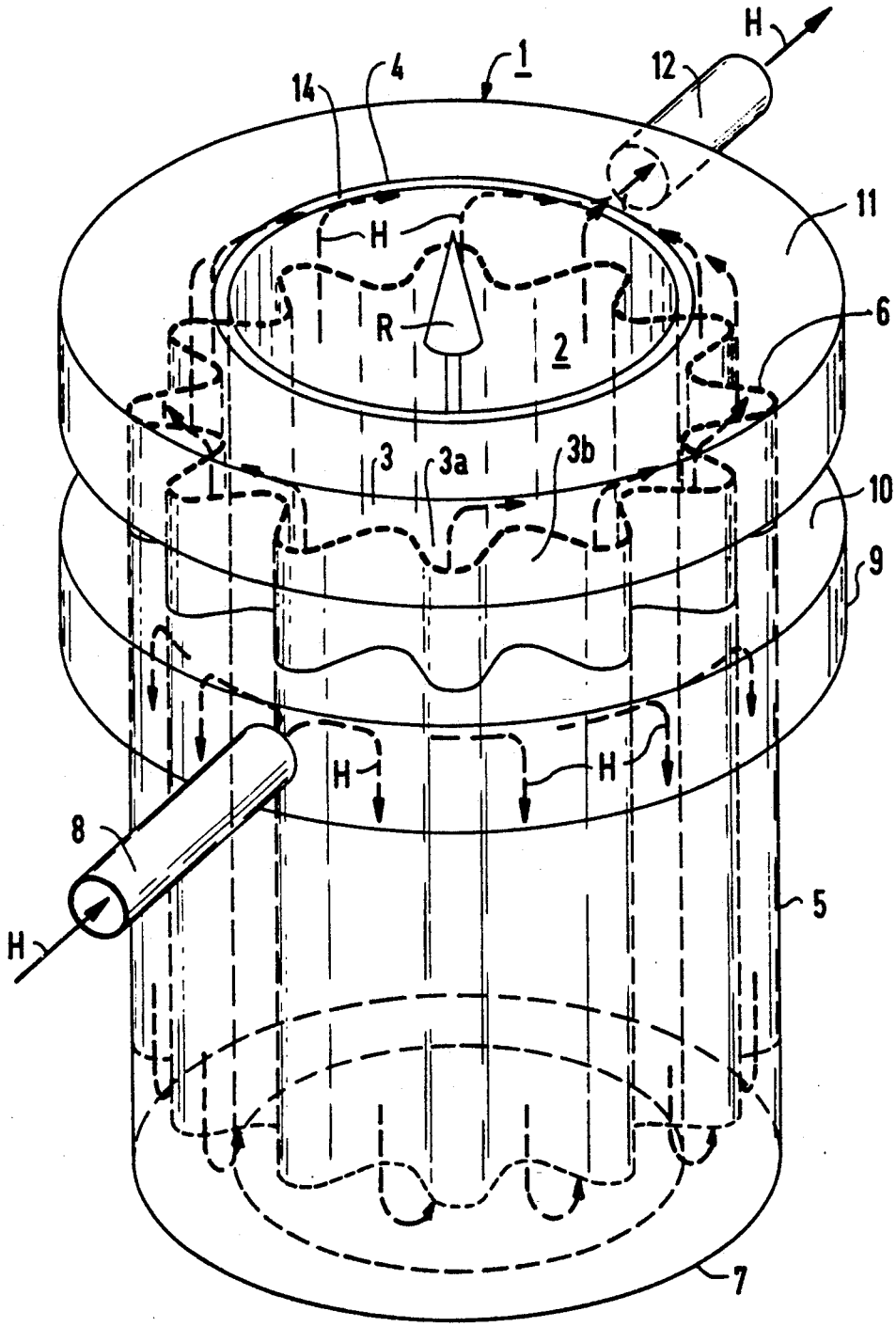
FIG. 1 is a diagrammatic, perspective view of a heat exchanger according to the invention.

Referring now to the figures of the drawing in detail and first, particularly, to FIG. 1 thereof, there is seen a heat exchanger 1 which includes a primary chamber 2, in which a hot primary medium, such as hot flue gas R, flows and a secondary chamber 3, in which a secondary medium that absorbs heat, such as heating gas H for a pyrolysis reactor, flows. The primary chamber 2 and the secondary chamber 3 are divided from one another by a wall 4. In FIG. 1, this wall 4 is formed by a tube that is round in cross section. However, any other cross section is also possible. The secondary chamber 3 is defined not only by the wall 4 but also by an outer jacket sheet 5. The secondary chamber 3 therefore forms an annular chamber around the primary chamber 2. The secondary chamber 3 is compartmented by a profiled sheet 6, into an inner partial chamber **3*a* and an outer partial chamber 3*b*. The profiled sheet 6 may be an endless corrugated sheet, which curves sinusoidally and thus alternatingly touches the wall 4 and the outer jacket sheet 5. This subdivides the inner partial chamber 3*a* and outer partial chamber 3*b* of the secondary chamber 3 into respective compartmented partial chambers, and the profiled sheet 6 serves as a spacer for the wall 4 and the outer jacket sheet 5. An exchange of heating gas H may be possible between the respective compartmented partial chambers, since the profiled sheet 6 is not joined to the wall 4 and to the outer jacket tube 5** in a gas-tight manner.

The two partial chambers **3*a* and 3*b* communicate with one another and are closed off from the outside on one end surface of the heat exchanger 1, which in FIG. 1 is the lower end surface. This connection is provided by means of a bottom 7. The profiled sheet 6 ends at some distance above the bottom 7. The heating gas H can therefore pass across this distance from the outer partial chamber 3*b* into the inner partial chamber 3*a***, or vice versa.

In order to provide for feeding heating gas H into the secondary chamber 3, an inflow line 8 is provided. The inflow line 8 discharges into a first collecting conduit 9 that surrounds the heat exchanger 1. The first collecting conduit 9 is open toward the outer partial chamber **3*b*. In FIG. 1, the outer partial chamber 3*b*, above the first collecting conduit 9, is closed by a closure sheet 10 disposed between the outer jacket sheet 5 and the profiled sheet 6. This assures that the introduced heating gas H is always conducted downward in the outer partial chamber 3*b*. Through the use of the first collecting conduit 9, the heating gas H is distributed to the compartmented partial chambers of the outer partial chamber 3*b*. The direction of flow of the heating gas H is reversed between the bottom 7 and the lower end of the profiled sheet 6, and the heating gas H then passes from the outer partial chamber 3*b* into the inner partial chamber 3*a*. There it flows upward as seen in FIG. 1 A second collecting conduit 11, which is open toward the inner partial chamber 3*a*** but not toward the outer partial chamber 3*b*, is disposed at the upper end of the heat exchanger 1. The second collecting conduit 11 can be divided from the outer partial chamber 3*b* by means of the closure sheet 10. However, a separate sheet may also be present, so that an opening from the outside extends between the collecting conduits 9 and 11 as far as the profiled sheet 6. The second collecting conduit 11 receives the heating gas H, which first flows from top to bottom in the outer partial chamber 3*b* and then from bottom to top in the inner partial chamber 3*a*. An outflow line 12 for the heating gas H communicates with the second collecting conduit 11. The profiled sheet 6 is mechanically joined to the wall 4 by the second collecting conduit 11. Some other rigid connection may instead be provided on the upper portion of the heat exchanger 1. The outer jacket sheet 5 is joined to the profiled sheet 6 by the first collecting conduit 9 and the closure sheet 10. Instead, the closure sheet 10 may be connected directly to the second collecting conduit 11, instead of to the profiled sheet 6, or may even be part of the second collecting conduit 11.

The hot primary medium, for instance the flue gas R, having a temperature which may be above 800° C., flows in the primary chamber. Like the secondary chamber 3, the primary chamber 2 communicates with inflow lines and outflow lines, which are not shown in FIG. 1.

The wall 4 of the primary chamber 2 is formed of a heat-resistant material. It is, for instance, pinned and tamped with a fireproof ceramic composition 14. All of the other parts of the heat exchanger 1 can be formed of an inexpensive sheet metal, because they only come into contact with the cooler secondary medium, which is the heating gas H. For instance, the heating gas H may have a temperature of 250° C. in the inflow line 8 and 600° C. in the outflow line 12.

Figure 2:
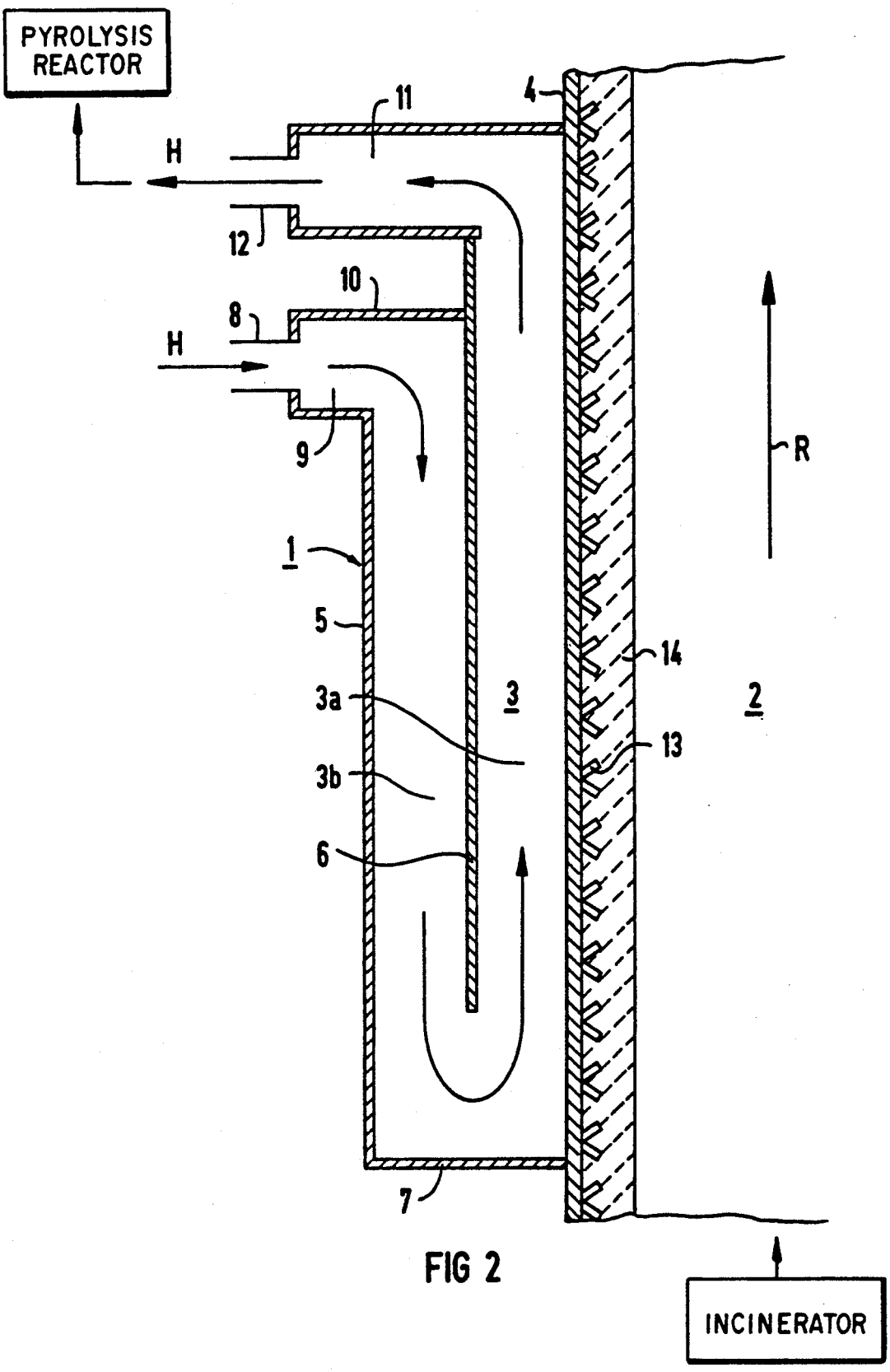
FIG. 2 is a fragmentary, radial-sectional view of the heat exchanger.
Figure 3:
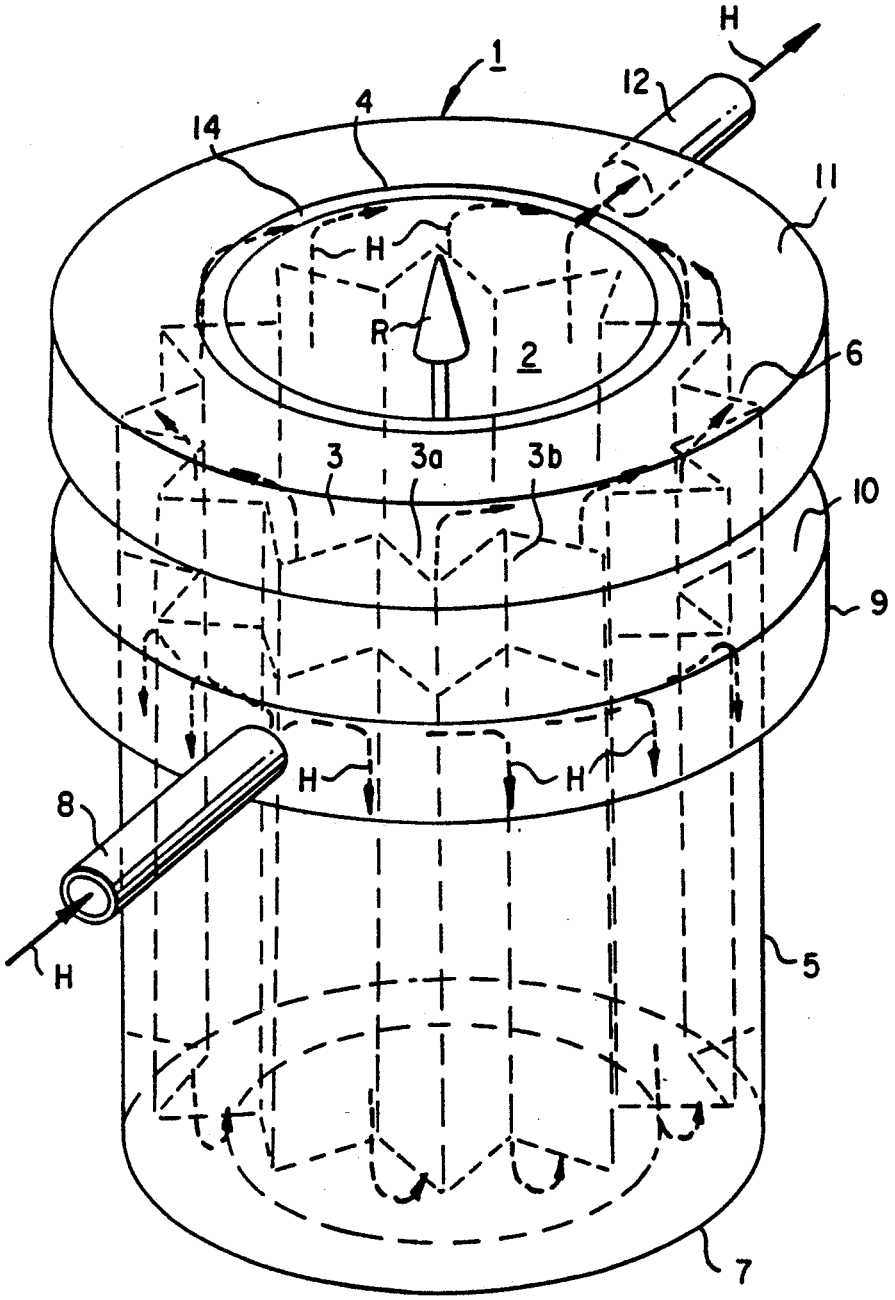
FIG. 3 is a view similar to FIG. 1 of a second embodiment of the invention.

FIG. 2 is a radial section through the secondary chamber 3 of the heat exchanger 1 of FIG. 1. The wall 4 of the primary chamber 2 is provided with pins 13 on the side of the primary chamber 2 and is tamped with the fire-proof ceramic composition 14. The pins 13 enable good adhesion of the ceramic composition 14. As mentioned above, the secondary chamber 3 is defined by the wall 4 and the outer jacket sheet 5. Through the use of the profiled sheet 6, the profiling of which is not visible in the sectional view of FIG. 2, the secondary chamber 3 is subdivided into the inner partial chamber 3*a* and an outer partial chamber 3*b*. Depending on the location at which the radial section is taken, the profiled sheet 6 is located directly at the wall 4, directly at the outer jacket sheet 5, or at some arbitrary point in between. This is because the profiled sheet is profiled in a plane at right angles to the plane of the drawing and at right angles to the wall 4, with the profile covering the entire width of the secondary chamber 3. The profile of the profiled sheet 6 may be a polygonal profile or a round profile, such as a sinusoidal one, or any otherwise shaped profile. The outer jacket sheet 5 is joined to the wall 4 by the bottom 7. This bottom 7 may be box-like in shape. The bottom 7 may also be constructed elastically, in order to compensate for unequal thermal strains. As mentioned above, one end of the profiled sheet 6 ends some distance above the bottom 7 in the secondary chamber 3. As also mentioned above, the outer partial chamber 3*b* is closed off at the top by the closure sheet 10. Below the closure sheet 10, the outer partial chamber 3*b* communicates with the inflow line 8. The first collecting conduit 9 may be located between the inflow line 8 and the outer partial chamber 3*b*. This collecting conduit 9 causes the various compartmented partial chambers of the outer partial chamber 3*b*, formed by the profiling of the profiled sheet 6, to communicate with one another. The inner partial chamber 3*a* communicates with the outflow line 12. A second collecting conduit 11 may be connected between them, in order to first collect the secondary medium emerging from the compartmented partial chambers of the inner partial chamber 3*a*. In FIG. 2, the other end of the profiled sheet 6 is secured solely to the second collecting conduit 11. Accordingly, it hangs like a curtain in the secondary chamber 3. As a result, thermal expansion of the profiled sheet 6 cannot have any effect on other components of the heat exchanger 1. The first collecting conduit 9 is retained in the profiled sheet 6 by the closure sheet 10, and the outer jacket sheet 5 is retained on the first collecting conduit 9. The primary medium, in particular the flue gas R, flows through the primary chamber at a temperature of 800° C., for instance. The secondary medium, in particular the heating gas H, flows at a temperature of 250° C., for instance, through the inflow line 8 and the first collecting conduit 9 into the outer partial chamber 3*b* of the secondary chamber 3. There it flows downward, changes its flow direction in front of the bottom 7, and then flows upward in the inner partial chamber 3*a*. From there, after being heated to 600° C., for instance, it passes through the second collecting conduit 11 into the outflow line 12.

An advantage attained with the heat exchanger 1 of the invention is that in order to construct a secondary chamber 3, only inexpensive material such as corrugated sheet metal is needed instead of expensive tubes, and that thermal expansion of the components of the heat exchanger 1 has no influence on its stability.

We claim:

1. A heat exchanger, comprising a primary chamber for a primary medium, a secondary chamber for a secondary medium, a gas-tight heat-conducting wall separating said chambers from one another, an outer jacket sheet being disposed at a distance from said wall and defining said secondary chamber along with sad wall, and a profiled sheet being disposed between said wall and said outer jacket sheet and subdividing said secondary chamber into an inner annular chamber and an outer annular chamber, said profiled sheet having a secured upper portion and hanging freely downward between said wall and said outer jacket sheet.

2. The heat exchanger according to claim 1, wherein said profiled sheet extends in flow direction of the primary medium and is profiled in a plane at right angles to the flow direction of the primary medium.

3. The heat exchanger according to claim 1, wherein said profiled sheet alternatingly touches said wall and said outer jacket sheet, forming compartmented partial chambers in said inner and outer partial chambers and maintaining said outer jacket sheet at a constant distance from said wall.

4. The heat exchanger according to claim 1, including an inflow line and an outflow line, said profiled sheet having two ends, said inner and outer partial chambers being joined together and closed off from the outside at one of said ends of said profiled sheet, and said outer partial chamber communicating with said inflow line and said inner partial chamber communicating with said outflow line at the other said ends of said profiled sheet.

5. The heat exchanger according to claim 4, including a bottom, said wall and said outer jacket sheet being joined in gas-tight fashion at said one end of said profiled sheet, and said one end of said profiled sheet ending at a distance from said bottom.

6. The heat exchanger according to claim 5, wherein said bottom is elastic.

7. The heat exchanger according to claim 5, including a closure sheet having sides, said closure sheet extending between said profiled sheet and said outer jacket sheet and closing said outer partial chamber at said other end of said profiled sheet; and first and second collecting conduits, said second collecting conduit being open toward said inner partial chamber and being disposed at one of said sides of said closure sheet, said second collecting conduit communicating with said outflow line; and said first collecting conduit being open toward said outer partial chamber and being disposed at the other of said sides of said closure sheet, and said first collecting conduit communicating with said inflow line.

8. The heat exchanger according to claim 7, wherein said outer jacket sheet has an outer surface, said first collecting conduit is mounted on said outer surface of said outer jacket sheet, and said outer jacket sheet has a continuous opening leading to said first collecting conduit.

9. The heat exchanger according to claim 7, wherein said other end of said profiled sheet is at an upper part of said profiled sheet at which said profiled sheet is secured and suspended.

10. The heat exchanger according to claim 1, wherein said profiled sheet has a polygonal profile.

11. The heat exchanger according to claim 1, wherein said profiled sheet is a corrugated sheet with a sinusoidal profile.

12. The heat exchanger according to claim 1, wherein at least one of said profiled and jacket sheets is formed of steel.

13. The heat exchanger according to claim 1, wherein at least part of said secondary chamber is formed of steel.

14. The heat exchanger according to claim 1, wherein said wall is formed of a relatively more expensive material for withstanding high temperatures, and said profiled sheet is formed of a relatively less expensive material.

15. The heat exchanger according to claim 1, wherein said wall has a side facing toward said primary chamber, and said side of said wall has pins and is tamped with a fireproof ceramic composition.

16. The heat exchanger according to claim 1, wherein the primary medium is a hot flue gas, and the secondary medium is a heating gas.

17. The heat exchanger according to claim 1, wherein the primary medium is a hot flue gas from a combustion chamber at an incineration plant, and the secondary medium is a heating gas for heating a pyrolysis reactor of an incineration plant.

18. A heat exchanger, comprising a gas-tight tube with a heat-conducting wall defining a primary chamber for a primary medium, a profiled sheet disposed at a distance from said tube, said profiled sheet having a secured upper portion and a free lower portion hanging freely downward, said profiled sheet together with said wall of said tube defining an inner annular chamber for a secondary medium, an outer jacket sheet disposed at a distance from said freely hanging profiled sheet, said outer jacket sheet together with said profiled sheet defining an outer annular chamber for the secondary medium, said inner and outer annular chambers communicating with one another through the secondary medium flowing past said free lower portion of said profiled sheet.

* * * * *